US007370426B2

(12) United States Patent
Choi

(10) Patent No.: US 7,370,426 B2
(45) Date of Patent: May 13, 2008

(54) CUTTING TEE SQUARE

(75) Inventor: Kyoung-Soo Choi, Seongnam-shi (KR)

(73) Assignee: Komelon Corporation, Saka-Ku, Pusan (KR)

( * ) Notice: Subject to any disclaimer, the term of this patent is extended or adjusted under 35 U.S.C. 154(b) by 0 days.

(21) Appl. No.: 11/433,121

(22) Filed: May 12, 2006

(65) Prior Publication Data

US 2007/0163130 A1 Jul. 19, 2007

(30) Foreign Application Priority Data

Jan. 19, 2006 (KR) ..... 10-2006-0005936

(51) Int. Cl.
*B25H 7/04* (2006.01)

(52) U.S. Cl. ..... 33/42; 33/479; 30/293

(58) Field of Classification Search ..... 33/32.2, 33/41.1, 41.6, 42, 43, 44, 492; 30/289, 290, 30/291, 293, 294, 295
See application file for complete search history.

(56) References Cited

U.S. PATENT DOCUMENTS

| | | | | | |
|---|---|---|---|---|---|
| 125,823 | A * | 4/1872 | Marden | 33/44 |
| 348,674 | A * | 9/1886 | Humphrey | 33/42 |
| 365,804 | A * | 7/1887 | Fales | 33/44 |
| 663,168 | A * | 12/1900 | Hembree | 33/44 |
| 685,634 | A * | 10/1901 | Olson et al. | 33/44 |
| 848,387 | A * | 3/1907 | Clark, Jr. | 33/486 |
| 1,046,975 | A * | 12/1912 | Leidahl | 33/42 |
| 1,195,886 | A * | 8/1916 | Wheeler | 33/42 |
| 1,598,993 | A * | 9/1926 | Vlazny | 33/42 |
| 1,877,185 | A * | 9/1932 | Lowe | 33/42 |
| 2,537,505 | A * | 1/1951 | Baran | 30/2 |
| 2,562,348 | A * | 7/1951 | Bowser, Jr. | 33/492 |
| 2,763,065 | A * | 9/1956 | Leidahl | 33/485 |
| 3,514,855 | A * | 6/1970 | Klekamp | 30/293 |
| 3,871,100 | A * | 3/1975 | Hildebrandt | 33/42 |
| 4,380,872 | A * | 4/1983 | Moran | 33/529 |
| 4,809,439 | A * | 3/1989 | Burns | 33/42 |
| 5,782,007 | A * | 7/1998 | Harris | 33/768 |
| 5,915,806 | A * | 6/1999 | Levee | 33/42 |
| 5,979,063 | A * | 11/1999 | Pritz | 30/293 |
| 6,691,425 | B1 * | 2/2004 | Lee et al. | 33/759 |
| 6,912,799 | B1 * | 7/2005 | Smith | 33/770 |

FOREIGN PATENT DOCUMENTS

| | | | |
|---|---|---|---|
| FR | 2600591 A1 | * | 12/1987 |
| GB | 2203839 A | * | 10/1988 |
| GB | 2236596 A | * | 4/1991 |

* cited by examiner

*Primary Examiner*—R. Alexander Smith
(74) *Attorney, Agent, or Firm*—DeLio & Peterson, LLC; Peter W. Peterson

(57) ABSTRACT

The apparatus includes a first plate for supporting the first surface of the article adjacent to the edge part of the article, a second plate extending from one end of the first plate in order to support the second surface of the article adjacent to the edge part of the article, a band connected to both side ends of the first plate such that a worker is able to securely hold the apparatus using one hand, and a non-skid member attached to at least one of inner surfaces of the first and second plates, which make contact with the first and second surfaces of the article, so as to prevent the apparatus from sliding along the article.

12 Claims, 6 Drawing Sheets

CUTTING TEE SQUARE

BACKGROUND OF THE INVENTION

1. Field of the Invention

The present invention relates to a cutting tee square. More particularly, the present invention relates to a cutting tee square equipped with cutting tools for simply and rapidly performing cutting work or drawing work with respect to various plate members.

2. Description of the Prior Art

As generally known in the art, a tee square is one of drawing instruments used for drawing lines. The tee square includes a body formed with scale marks and a head installed perpendicularly to the body. The user can draw various lines using the body of the tee square or set squares cooperating with the body of the tee square while moving the tee square up and down along a lateral side of a drawing board in a state in which a basis plane of the head closely adheres to the lateral side of the drawing board. Meanwhile, a cutting tee square has been developed by modifying the tee square in order to cut various plate members used as construction materials, such as boards, panels or glass plates.

For instance, Korean Utility Model Registration No. 20-32981 discloses a "board cutting ruler" in which a fixing square is movably installed in a hole of a transverse bar, one end of a ruler formed with scale marks is coupled to the fixing square, and a slider is coupled to the ruler such that the slider can move lengthwise along the ruler. In addition, a cutter blade is installed on a lower surface of the slider so as to cut a board. According to the above board cutting ruler, the fixing square moves lengthwise along the transverse bar together with the ruler or the slider moves lengthwise along the ruler in such a manner that the board or plate members can be cut by means of the cutter blade.

In addition, Korean Utility Model Registration No. 20-32981 discloses a "glass cutting T-measure" in which one end of a square is fixed to the center of an upper surface of a support member and a cutter is installed on the square such that the cutter can move lengthwise along the square. According to the above glass cutting T-measure, the cutter moves lengthwise along the square in a state in which the support member closely adheres to one end of the glass plate, thereby cutting the glass plate.

However, according to the above conventional cutting squares, the user must move the cutter lengthwise along the square in order to cut the plate member. Therefore, when it is necessary to cut a plate member having a length larger than that of the square, the user must repeat the cutting work several times while moving the cutting square along the cutting line formed in the plate member. Since the cutting work for the plate member must be performed several times, workability may be significantly degraded.

In addition, the board cutter and the glass cutter are dedicated to cut the board and glass, respectively. Accordingly, the user must purchase both the board cutter and the glass cutter, which imposes excessive expenses on the user and causes inconvenience to the user because the user must carry the board cutter and the glass cutter so as to use them.

Meanwhile, an ink scale is used in various construction fields in order to draw lines on plate members. That is, after measuring the size of the plate member, drawing lines are marked on both side ends of the plate member. Then, one end of the ink scale is fixed to the drawing line marked on one end of the plate member and the other end of the ink scale is aligned corresponding to the drawing line marked on the other end of the plate member. In this state, the user pulls and releases the ink scale in such a manner that ink marks can be formed on the plate member. However, this may lengthen working time while complicating the drawing work.

SUMMARY OF THE INVENTION

Accordingly, the present invention has been made to solve the above-mentioned problems occurring in the prior art, and an object of the present invention is to provide a cutting tee square including a head, a body and a cutting tool, in which, after determining a cutting size of a plate by moving the body relative to the head, the head and the body are moved along one end of the plate together with the cutting tool while supporting a blade of the cutting tool on the plate and a front end portion of the body, thereby precisely and simply cutting various plates at a high speed.

Another object of the present invention is to provide a cutting tee square including a head, a body and a cutting tool or a writing tool, in which the head and the body are moved simultaneously with the cutting tool or the writing tool so that cutting work or drawing work can be performed through a single process regardless of a length of a plate and in which a user can exchange the cutting tool with a new one depending on the type of the plates.

In order to accomplish these objects, there is provided a cutting tee square used for cutting various plates using a cutting tool, the cutting tee square comprising: a head having a basis plane, which closely adheres to one end of a plate so as to serve as a basis line for cutting, and being provided at an upper surface thereof with a guide having a hole extending widthwise along the head; a body movably inserted into the hole of the guide and provided at both lateral sides thereof with straight blades having scale marks; a first handle installed on an upper surface of the body adjacent to a front end portion of the body so as to allow a user to grip the first handle together with the cutting tool; and a fixing unit installed through the guide so as to securely fix the body to the head.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
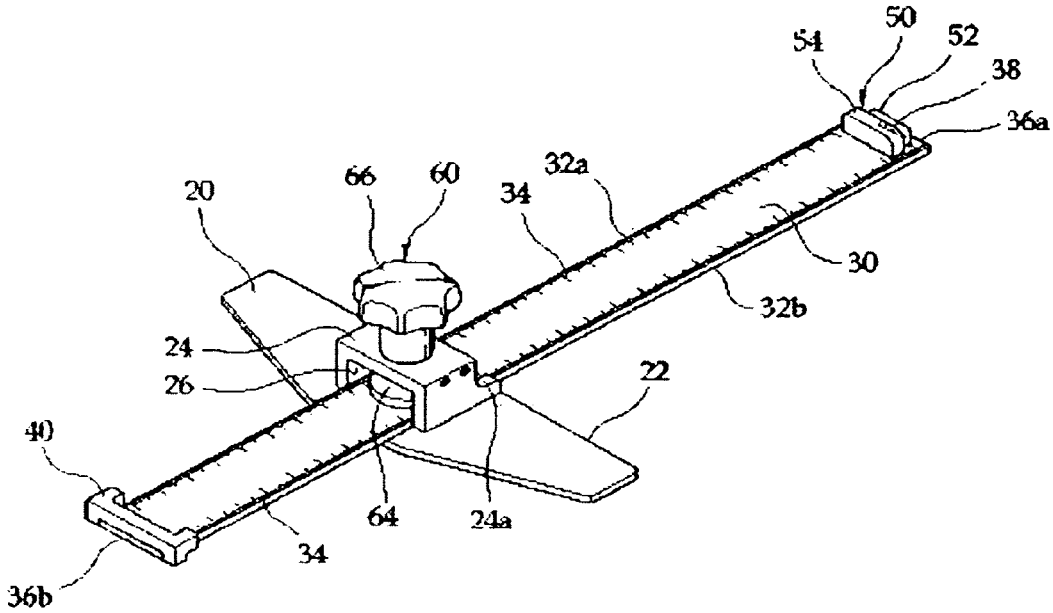
FIG. 1 is a perspective view illustrating a cutting tee square according to one embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
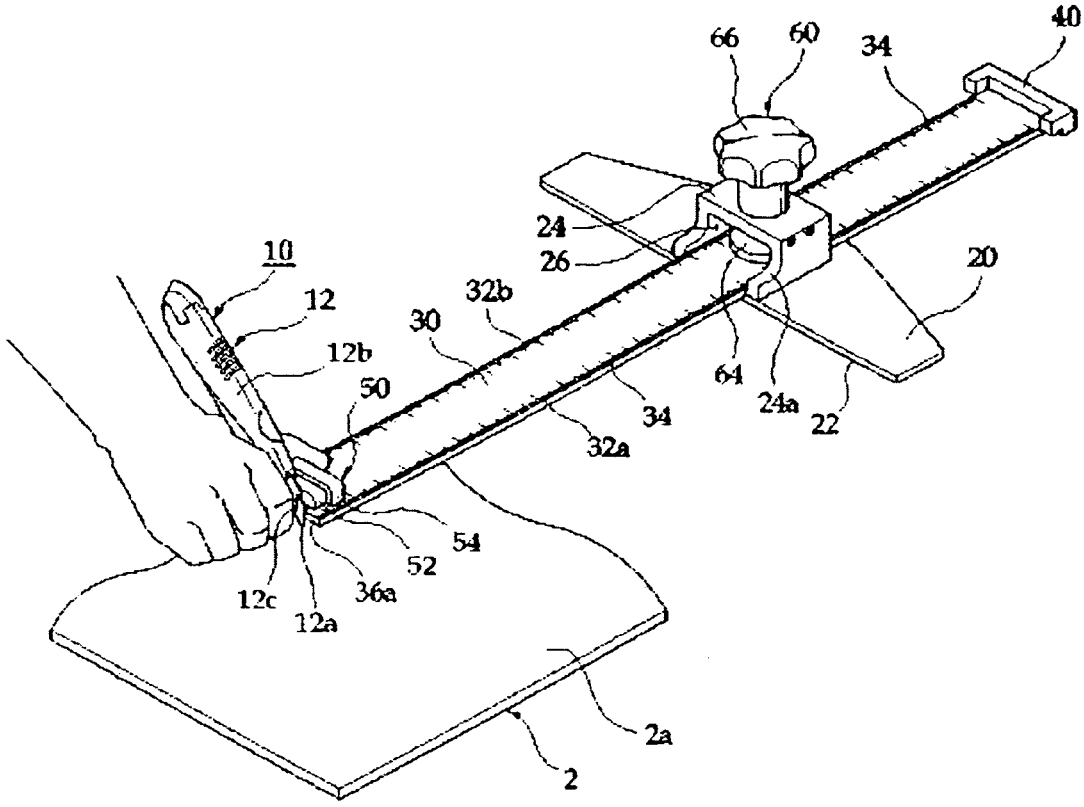
FIG. 2 is a perspective view illustrating the operational state of a cutting tee square for cutting a plate member using a cutter according to one embodiment of the present invention.
Figure 3:
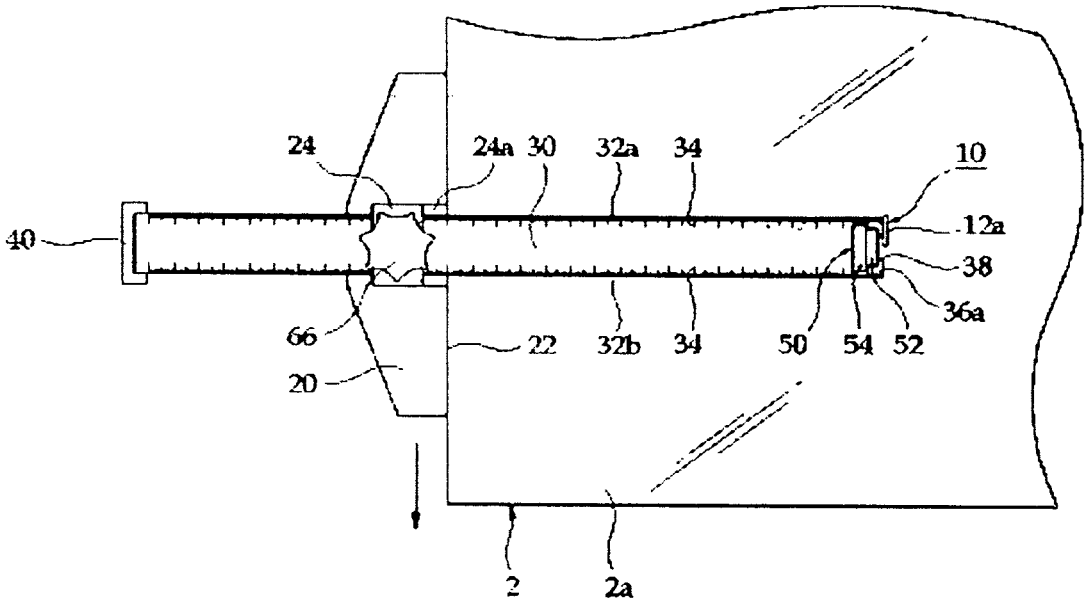
FIG. 3 is a plan view illustrating the operational state of a cutting tee square for cutting a plate member using a cutter according to one embodiment of the present invention.
Figure 4:
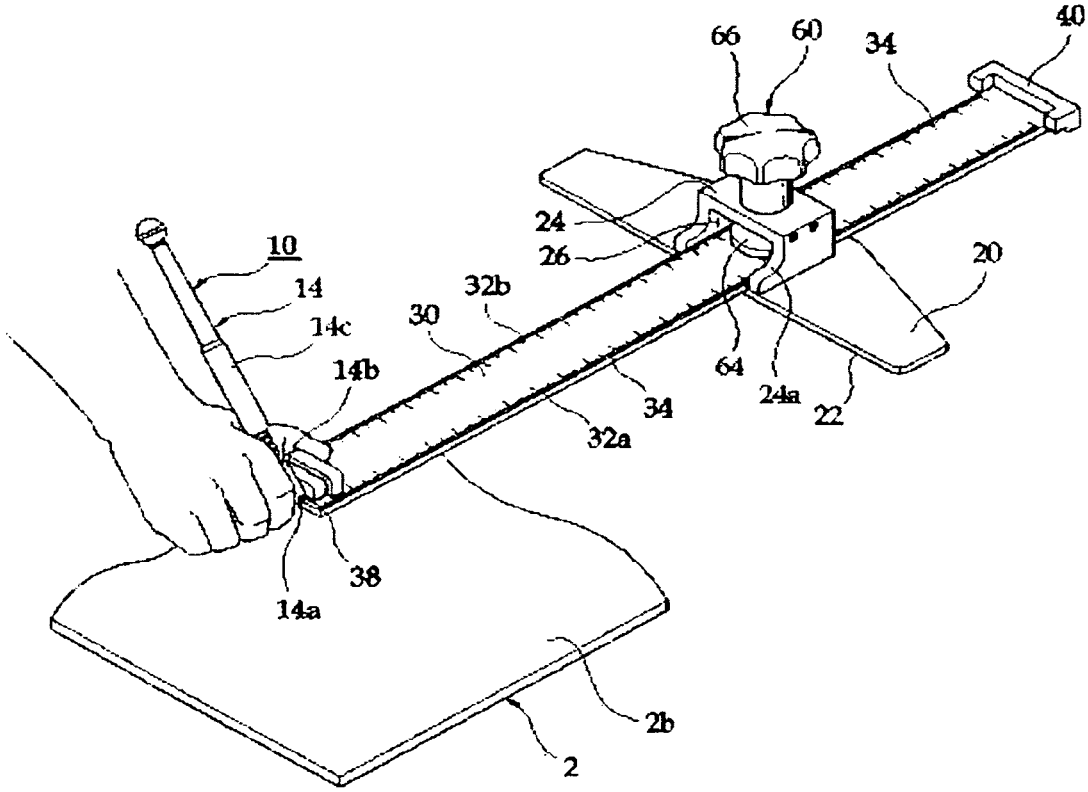
FIG. 4 is a perspective view illustrating the operational state of a cutting tee square for cutting a glass plate using a glass cutter according to one embodiment of the present invention.
Figure 5:
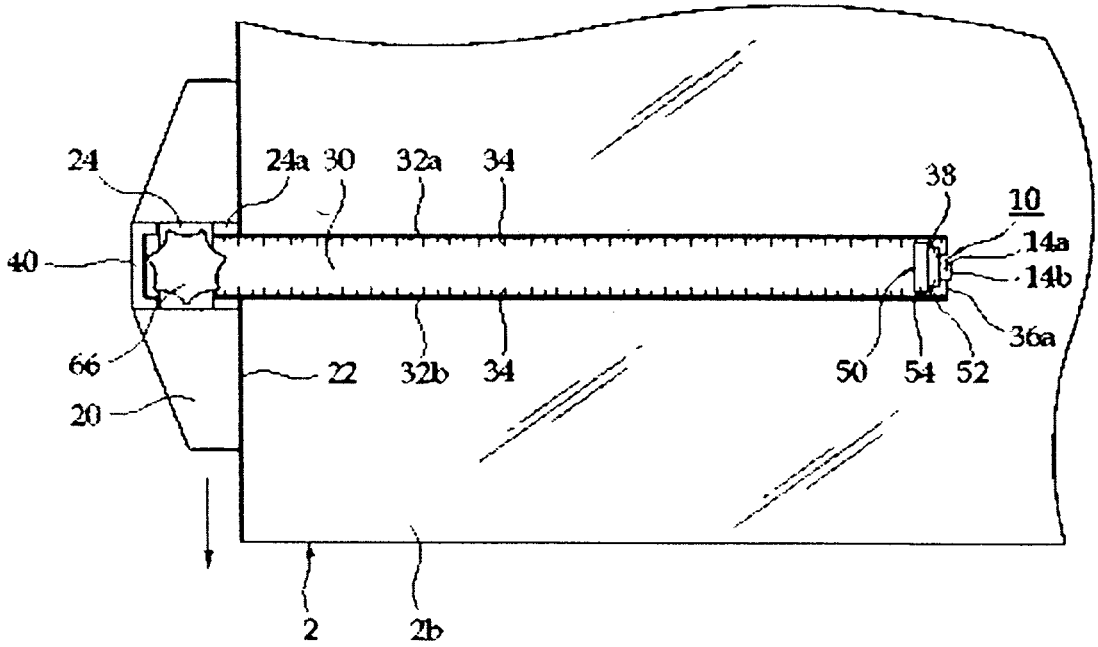
FIG. 5 is a plan view illustrating the operational state of a cutting tee square for cutting a glass plate using a glass cutter according to one embodiment of the present invention.
Figure 6:
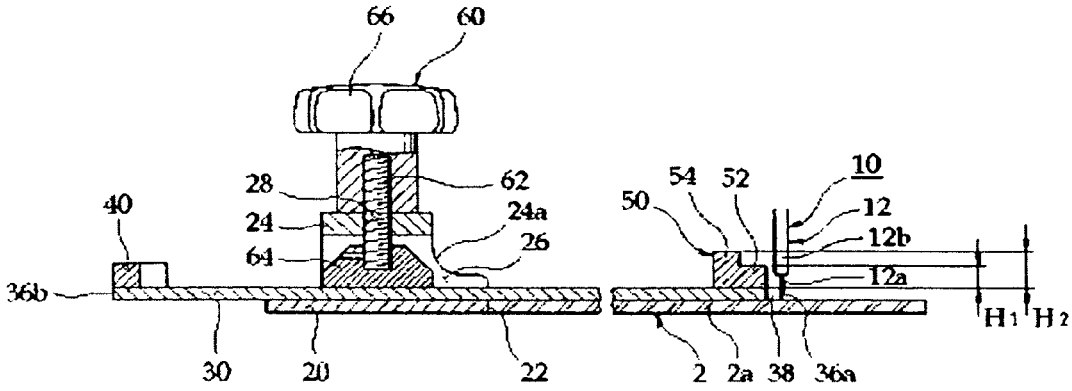
FIG. 6 is a sectional view illustrating a body fixed to a head by means of a fixing unit in a cutting tee square according to one embodiment of the present invention.
Figure 7:
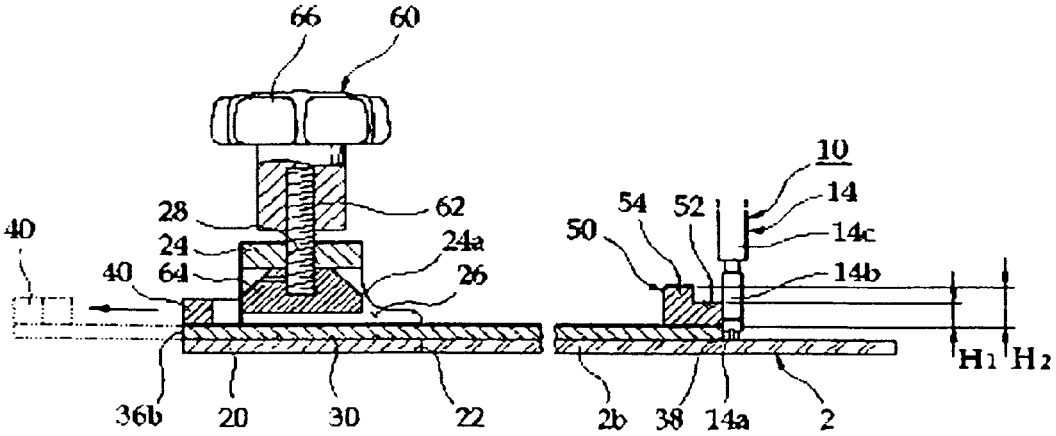
FIG. 7 is a sectional view illustrating a body being moved relative to a head in a cutting tee square according to one embodiment of the present invention.

Referring to FIGS. 1, 2 and 4, a cutting tee square according to the present invention includes a cutting tool 10 used for performing cutting work or drawing work with respect to a plate 2, such as a board, a panel or a glass plate. FIGS. 2, 3 and 6 show the cutting tool 10 including a cutter 12 used for cutting a board 2*a*, such as a gypsum board, a veneer board, or a Styrofoam panel. The cutter 12 includes a blade 12*a* and a blade housing 12*b* for receiving the blade 12*a* therein. The blade 12*a* is in the form of a "cutter blade" which can be chopped into several pieces through cutting lines 12*c*. FIGS. 4, 5 and 7 show the cutting tool 10 including a glass cutter 14 used for cutting a glass plate 2*b*. The glass cutter 14 includes a holder 14*b* equipped with a blade 14*a* and a handle 14*c* connected to the holder 14*b* such that the user can grip the holder 14*b* using the handle 14*c*.

Referring to FIGS. 1, 2, 4, 6 and 7, the cutting tee square according to the present invention includes a head 20 and a body 30 coupled to the head 20 and installed perpendicularly to the head 20. A basis plane 22 is formed at one end of the head 20. The basis plane 22 adheres to one lateral end of the plate 2 so as to serve as a basis line for cutting. A guide 24 is installed at the center of an upper surface of the head 20. The guide 24 has a hole 26 having a rectangular section and extending widthwise along the head 20. A screw hole 28 is formed at the center of an upper surface of the guide 24. A front end of the guide 24 is aligned in line with the basis plane 22 of the head 20 and a cutting section 24*a* is formed at a front portion of the guide 24 so as to allow the user to easily see the basis plane 22 of the head 20.

The body 30 is movably inserted into the hole 26 formed in the guide 24 such that the body 30 forms a "T" shape together with the head 20. The body 30 has a length suitable for cutting work and drawing work for the plate 2. For instance, the body 30 has a length of 60 cm. Straight blades 32*a* and 32*b* are provided at both lateral sides of the body 30 and scale marks 34 are formed lengthwise along the straight blades 32*a* and 32*b* of the body 30 so as to measure the length of an object. The user can easily see the scale mark 34 aligned at the basis plane 22 of the head 20 through the cutting section 24*a* of the guide 24.

In addition, a groove 38 is formed at a front end portion 36*a* of the body 30 so as to receive the cutting tool 10, that is, the blade 12*a* the cutter 12 or the holder 14*b* of the glass cutter 14. A stopper 40 is installed at a rear end portion 36*b* of the body 30. The stopper 40 is coupled with one end of the guide 24 so that the body 30 can be prevented from being separated from the hole 26 of the guide 24.

As shown in FIGS. 6 and 7, a first handle 50 is mounted on the upper surface of the body 30 adjacent to the front end portion 36*a* of the body 30 so as to allow the user to grip the first handle 50 together with the cutting tool 10. The first handle 50 includes a first protrusion 52 fixed to the upper surface of the body 30 adjacent to the front end portion 36*a* of the body 30 and a second protrusion 54 integrally formed with a lateral portion of the first protrusion 52 while extending toward the rear end portion 36*b* of the body 30.

On the basis of the upper surface of the body 30, the first protrusion 52 has a first predetermined height H1 in such a manner that the blade housing 12*b* may not interfere with an upper end portion of the first protrusion 52 when performing the cutting work for the plate 2 by extracting the blade 12*a* from the blade housing 12*b* of the cutter 12 while supporting the blade 12*a* on the front end portion 36*a* of the body 30. In addition, as shown in FIGS. 2 and 4, the second protrusion 54 has a second predetermined height H2 higher than the first predetermined height H1 of the first protrusion 52, so that the user is able to make contact with the lateral side of the second protrusion 54 by using a finger of the user.

Referring again to FIGS. 1, 2, 4, 6 and 7, the cutting tee square of the present invention further includes a fixing unit 60 installed through the guide 24 so as to securely fix the body 30 to the head 20. The fixing unit 60 includes a screw 62 screw-coupled into a screw hole 28 of the guide 24, a pressing plate 64 installed at a lower end portion of the screw 62 so as to press the body 30 toward the head 20, and a second handle 66 installed at an upper end portion of the screw 62 so as to allow the user to rotate the screw 62 in the forward or reverse direction. In addition, the user can easily move the cutting tee square of the present invention to another places by gripping the second handle 66.

Hereinafter, the operation of the cutting tee square having the above structure according to the present invention will be described.

Referring to FIG. 7, if the user releases the screw 62 from the screw hole 28 of the guide 24 by rotating the second handle 66 of the fixing unit 60, the pressing plate 64 is spaced apart from the upper surface of the body 30 so that the user can move the body 30 along the hole 26 of the guide 24.

In this state, the user closely adheres the basis plane 22 of the head 20 to one end of the plate 2 and then moves the body 30 along the hole 26 of the guide 24 such that the front end portion 36*a* of the body 30 can be precisely aligned in line with the cutting position of the plate 2. At this time, the user can precisely set the cutting size of the plate 2 by measuring the length between one end of the plate 2 and the cutting position of the plate 2 based on the scale marks 34 formed along the straight blades 32*a* and 32 of the body 30.

Then, as shown in FIG. 6, after aligning the front end portion 36*a* of the body 30 in line with the cutting position of the plate 2, the user again fastens the screw 62 by rotating the second handle 66 of the fixing unit 60. As the screw 62 is again fastened, the pressing plate 64 presses the upper surface of the body 30 so that the body 30 can be securely fixed between the head 20 and the pressing plate 64.

Referring to FIGS. 2 to 5, the user adheres the basis plane 22 of the head 20 to one end of the plate 2 by gripping the second handle 66 of the fixing unit 60 using one hand of the user. In this state, the user adheres the blade 12*a* of the cutting tool 10 to the front end portion 36*a* of the body 30 using the other hand of the user such that the plate 2 can be cut by means of the blade 12*a* of the cutting tool 10. At the same time, the user grips the second protrusion 54 of the first handle 50 together with the cutting tool 10 so as to securely hold the cutting tool 10. At this time, the user can apply force to the lateral side of the second protrusion 54 by using the thumb of the user. Meanwhile, as shown in FIGS. 4, 5 and 7, the holder 14*b* of the glass cutter 154 is received in the groove 38 of the body 30.

As shown in FIG. 2, the height H1 of the first protrusion 52 positioned adjacent to the front end portion 36*a* of the body is preset such that the blade housing 12*b* may not interfere with the upper end portion of the first protrusion 52 when the blade 12*a* of the cutter 12 adheres to the plate 2 and the front end portion 36*a* of the body 30. In addition, the height H2 of the second protrusion 54 is higher than the height H1 of the first protrusion 52, so that the user can safely grip the blade housing 12*b* and the second protrusion 54 with strong force, thereby securely holding the cutter 12. As a result, it is possible to precisely and easily cut the plate 2 at a high speed.

In addition, the user adheres the basis plane 22 of the head 20 to one end of the plate while supporting the blade 12*a* of the cutter 12 on the plate 2 and the front end portion 36*a* of the body 30, and then moves the head 20 along the cutting line of the plate 2 by using the second handle 66. As the head 20 moves, the body 30 and the cutter 12 are also moved, so that the plate 2 is cut by means of the blade 12*a* of the cutter 12. The blade 12*a* of the cutter may move parallel to one end of the plate 2, the cutting line of the plate 2 can be maintained parallel to one end of the plate 2, so that the plate 2 can be precisely and easily cut at a high speed through a single cutting process regardless of the length of the plate 2.

In addition, a typical writing tool can be provided in the cutting tee square of the present invention, instead of the cutting tool 10, so as to draw lines on the upper surface of the plate. The procedure of the drawing work is substantially similar to that of the cutting work, so it will not be further described below.

As described above, according to the cutting tee square of the present invention, after determining the cutting size of the plate by moving the body having the scale marks relative to the head, the head and the body are moved along one end of the plate together with the cutting tool while supporting the blade of the cutting tool on the plate and the front end portion of the body, thereby precisely and simply cutting various plates at a high speed. In addition, the head and the body are moved simultaneously with the cutting tool or the writing tool so that cutting work or drawing work can be performed through a single process regardless of the length of the plate and the user can exchange the cutting tool with a new one depending on the type of the plates.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cutting tee square used for cutting various plates using a cutting tool having a blade and a blade housing for receiving the blade therein, the cutting tee square comprising:

a head having a basis plane, which closely adheres to one end of a plate so as to serve as a basis line for cutting, and being provided at an upper surface thereof with a guide having a hole extending widthwise along the head;

a body movably inserted into the hole of the guide and provided at both lateral sides thereof with straight blades having scale marks;

a first handle installed on an upper surface of the body adjacent to a front end portion of the body, the first handle having a free lateral side extending upward from the body upper surface a first predetermined height so as to allow a user to grip with one hand the first handle together with the cutting tool against the first handle free lateral side, the first handle including a first protrusion fixed to the upper surface of the body adjacent to the front end portion of the body and a second protrusion integrally formed with a lateral portion of the first protrusion while extending toward a rear end portion of the body, in which, on the basis of the upper surface of the body, the first protrusion has the first predetermined height in such a manner that the blade housing does not interfere with an upper end portion of the first protrusion when performing cutting work for the plate by extracting the blade from the blade housing while supporting the blade on the front end portion of the body, and the second protrusion has a second predetermined height higher than the first predetermined height of the first protrusion, so that the user is able to make contact with the lateral side of the second protrusion by using a finger of the user; and a fixing unit installed through the guide so as to securely fix the body to the head.

2. The cutting tee square as claimed in claim 1, wherein the fixing unit comprises:

a screw screw-coupled through an upper surface of the guide;

a pressing plate installed at a lower end portion of the screw so as to press the body toward the head; and a second handle installed at an upper end portion of the screw so as to allow the user to rotate the screw in the forward or reverse direction and to move the head and the body.

3. The cutting tee square as claimed in claim 1 or 2, further comprising a stopper installed at a rear end portion of the body and coupled with one end of the guide so as to prevent the body from being separated from the hole of the guide.

4. The cutting tee square as claimed in claim 1 or 2, further comprising a groove formed at the front end portion of the body so as to receive the cutting tool therein, wherein a cutting section is formed at one side of the guide adjacent to the basis plane of the head so as to allow the user to easily see the scale marks of the body aligned in line with the basis plane of the head.

5. A cutting tee square used for cutting various plates using a cutting tool having a blade and a blade housing for receiving the blade therein, the cutting tee square comprising:

a head having a basis plane, which closely adheres to one end of a plate so as to serve as a basis line for cutting, and being provided at an upper surface thereof with a guide having a hole extending widthwise along the head;

a body movably inserted into the hole of the guide and provided at both lateral sides thereof with straight blades having scale marks, the body having an upper surface and a lower surface;

a first handle installed on the upper surface of the body adjacent to a front end portion of the body so as to allow a user to grip the first handle together with the cutting tool, the first handle and body being free of any protrusion extending below the lower surface of the body adjacent to the front end portion of the body, the first handle including a first protrusion fixed to the upper surface of the body adjacent to the front end portion of the body and a second protrusion integrally formed with a lateral portion of the first protrusion while extending toward a rear end portion of the body, in which, on the basis of the upper surface of the body, the first protrusion has a first predetermined height in such a manner that the blade housing does not interfere with an upper end portion of the first protrusion when performing cutting work for the plate by extracting the blade from the blade housing while supporting the blade on the front end portion of the body, and the second protrusion has a second predetermined height higher than the first predetermined height of the first protrusion, so that the user is able to make contact with the lateral side of the second protrusion by using a finger of the user; and a fixing unit installed through the guide so as to securely fix the body to the head.

6. The cutting tee square as claimed in claim 5, wherein the fixing unit comprises:

a screw screw-coupled through an upper surface of the guide;

a pressing plate installed at a lower end portion of the screw so as to press the body toward the head; and a second handle installed at an upper end portion of the screw so as to allow the user to rotate the screw in the forward or reverse direction and to move the head and the body.

7. The cutting tee square as claimed in claim 5, further comprising a stopper installed at a rear end portion of the body and coupled with one end of the guide so as to prevent the body from being separated from the hole of the guide.

8. The cutting tee square as claimed in claim 5, further comprising a groove formed at the front end portion of the body so as to receive the cutting tool therein, wherein a cutting section is formed at one side of the guide adjacent to the basis plane of the head so as to allow the user to easily see the scale marks of the body aligned in line with the basis plane of the head.

9. A cutting tee square used for cutting various plates using a cutting tool having a blade and a blade housing for receiving the blade therein, the cutting tee square comprising:

a head having a basis plane, which closely adheres to one end of a plate so as to serve as a basis line for cutting, and being provided at an upper surface thereof with a guide having a hole extending widthwise along the head;

a body movably inserted into the hole of the guide and provided at both lateral sides thereof with straight blades having scale marks, the body having an upper surface and a lower surface;

a first handle installed on the upper surface of the body adjacent to a front end portion of the body, the first handle having a free lateral side extending upward from the body upper surface a first predetermined height so as to allow a user to grip with one hand the first handle together with the cutting tool against the first handle free lateral side, the first handle and body being free of any protrusion extending below the lower surface of the body adjacent to the front end portion of the body, first handle including a first protrusion fixed to the upper surface of the body adjacent to the front end portion of the body and a second protrusion integrally formed with a lateral portion of the first protrusion while extending toward a rear end portion of the body, in which, on the basis of the upper surface of the body, the first protrusion has the first predetermined height in such a manner that the blade housing does not interfere with an upper end portion of the first protrusion when performing cutting work for the plate by extracting the blade from the blade housing while supporting the blade on the front end portion of the body, and the second protrusion has a second predetermined height higher than the first predetermined height of the first protrusion, so that the user is able to make contact with the lateral side of the second protrusion by using a finger of the user; and a fixing unit installed through the guide so as to securely fix the body to the head.

10. The cutting tee square as claimed in claim 9, wherein the fixing unit comprises:

a screw screw-coupled through an upper surface of the guide;

a pressing plate installed at a lower end portion of the screw so as to press the body toward the head; and a second handle installed at an upper end portion of the screw so as to allow the user to rotate the screw in the forward or reverse direction and to move the head and the body.

11. The cutting tee square as claimed in claim 9, further comprising a stopper installed at a rear end portion of the body and coupled with one end of the guide so as to prevent the body from being separated from the hole of the guide.

12. The cutting tee square as claimed in claim 9, further comprising a groove formed at the front end portion of the body so as to receive the cutting tool therein, wherein a cutting section is formed at one side of the guide adjacent to the basis plane of the head so as to allow the user to easily see the scale marks of the body aligned in line with the basis plane of the head.

* * * * *